United States Patent [19]

Laskaris

[11] Patent Number: 5,047,741

[45] Date of Patent: Sep. 10, 1991

[54] EPOXY-IMPREGNATED SUPERCONDUCTIVE TAPE COILS

[75] Inventor: Evangelos T. Laskaris, Schenectady, N.Y.

[73] Assignee: General Electric Company, Schenectady, N.Y.

[21] Appl. No.: 395,635

[22] Filed: Aug. 17, 1989

[51] Int. Cl.[5] ..... H01F 7/22

[52] U.S. Cl. ..... 335/216; 174/125.1

[58] Field of Search ..... 330/216, 299; 174/125.1; 324/318, 319, 320

[56] References Cited

U.S. PATENT DOCUMENTS 4,234,861 11/1980 Woolcock et al. ..... 335/216

4,554,407 11/1985 Ceresara et al. ..... 174/125.1

FOREIGN PATENT DOCUMENTS 2139378 1/1973 Fed. Rep. of Germany ... 174/125.1

1130464 10/1968 United Kingdom ..... 174/125.1

*Primary Examiner*—George Harris

*Attorney, Agent, or Firm*—James R. McDaniel; James C. Davis, Jr.; Paul R. Webb, II

[57] ABSTRACT

A superconductive foil and a first and second foil of current conducting material. The first and second foil are soldered symmetrically about said superconductive foil forming a superconductive tape. The tape is wound in helical layers forming a coil. Adjacent turns of the tape are electrically insulated from one another. A strip of electrically conductive foil is situated between layers of tape and electrically isolated therefrom. The strip of electrically conductive foil encloses the inner layers of the tape, with the ends of the strip joined together to form an electrically conductive loop. The coil is epoxy resin impregnated.

12 Claims, 3 Drawing Sheets

EPOXY-IMPREGNATED SUPERCONDUCTIVE TAPE COILS

CROSS REFERENCE TO RELATED APPLICATIONS

The present invention is related to the following copending applications: Ser. No. 395,636, entitled "Magnet Cartridge for Magnetic Resonance Magnet"; Ser. No. 395,637now U.S. Pat. No. 4,986,078; and Ser. No. 395,634, entitled "Demountable Coil Form for Epoxy-Impregnated Coils".

BACKGROUND OF THE INVENTION

The present invention relates to niobium tin tape magnet coils which has been epoxy impregnated and do not require helium cooling for stability.

Niobium tin tape superconductors have been made by several processes, namely the GE/IGC tin dip-reaction process by Benz, CVD process by RCA, or the plasma spray process by Union Carbide. These tapes have been used extensively to make high field magnets which are cooled by pool boiling in liquid helium or forced convection of gaseous helium to stabilize the superconductor against flux jumps. Flux jumps can be understood by considering what happens when a magnetic field occurs perpendicular to a face of a superconducting tape. The magnetic field induces currents in the tape according to Lenz's Law, which try to screen the superconducting tape from the field. As long as the induced currents are below the critical current of the material, the currents persist. If the field increases or a section of the superconducting tape is externally heated, and the critical current is exceeded, heat is generated by the flowing current and the current decay. The flux then penetrates further into the superconducting tape inducing additional currents in the tape. Since critical current density of a superconductor generally decreases with increasing temperature, a temperature rise can lead to further flux penetration, which generates heat, leading to a still greater temperature rise. This thermal magnetic feedback can under some conditions lead to a thermal runaway, a catastrophic flux jump. Not all flux jumps lead to thermal runaway. If a flux jump occurs and the current induced does not exceed the critical current density, the flux jump stops. Direct cooling of the superconducting tape with helium has been widely accepted as the only feasible method to stabilize tape against flux jumps. Because of the inherent flux jump instability of niobium tin tapes and the complicated method of cooling tape magnets which requires a porous structure and the use of helium, the use of superconductive tape magnets has been rather limited and never commercialized in spite of the fact that niobium tin tape is the lowest cost superconductor. Instead, the effort was concentrated in making multifilamentary niobium tin superconductor wire, which due to the fine subdivision of the superconductor is inherently stable, but many times more expensive.

It is an object of the present invention to provide a coil of superconductive tape that does not require helium cooling for stability.

It is a further object of the present invention to provide free standing coil of superconductive tapes suitable for use in magnetic resonance imaging magnets cooled by refrigeration.

SUMMARY OF THE INVENTION

In one aspect of the present invention a superconductive tape coil is provided having a superconductive foil and a first and second foil of current conducting material. The first and second foil are soldered symmetrically about said superconductive foil forming a superconductive tape. The tape is wound in helical layers forming a coil. Adjacent turns of the tape are electrically insulated from one another. A strip of electrically conductive foil is situated between layers of tape and electrically isolated therefrom. The strip of electrically conductive foil encloses the inner layers of the tape, with the ends of the strip joined together to form an electrically conductive loop. The coil is epoxy resin impregnated.

BRIEF DESCRIPTION OF THE DRAWING

While the specification concludes with claims particularly pointing out and distinctly claiming the present invention, the objects and advantages can be more readily ascertained from the following description of a preferred embodiment when read in conjunction with the accompanying drawing in which:

DETAILED DESCRIPTION OF THE INVENTION

Figure 1:
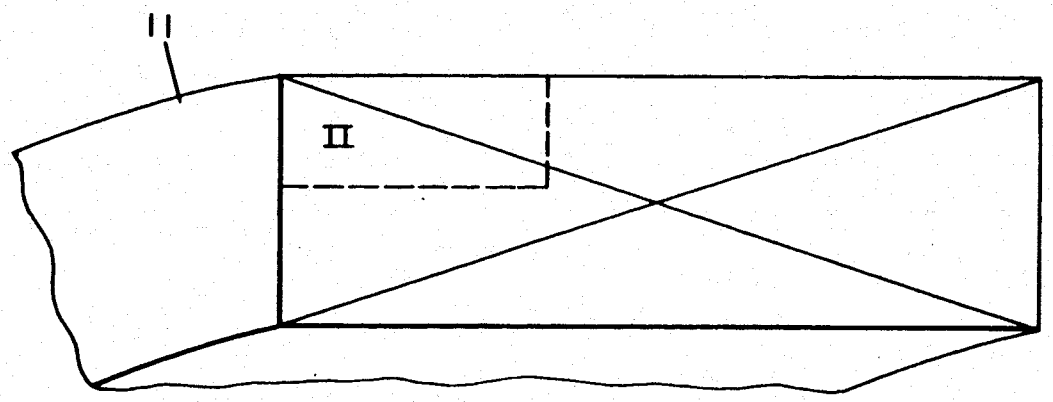
FIG. 1 is a partial, isometric view of an epoxy impregnated superconductive tape coil in accordance with the present invention.
Figure 2:
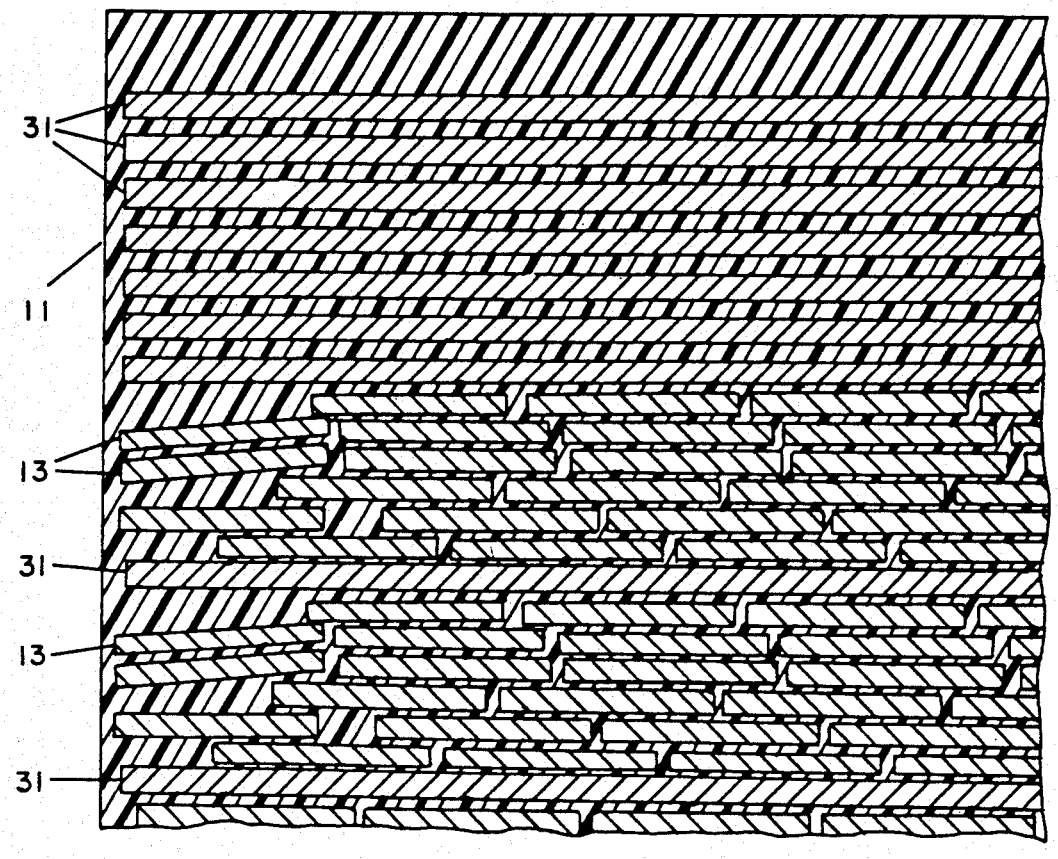
FIG. 2 is an enlarged view of area II in FIG. 1.
Figure 3:
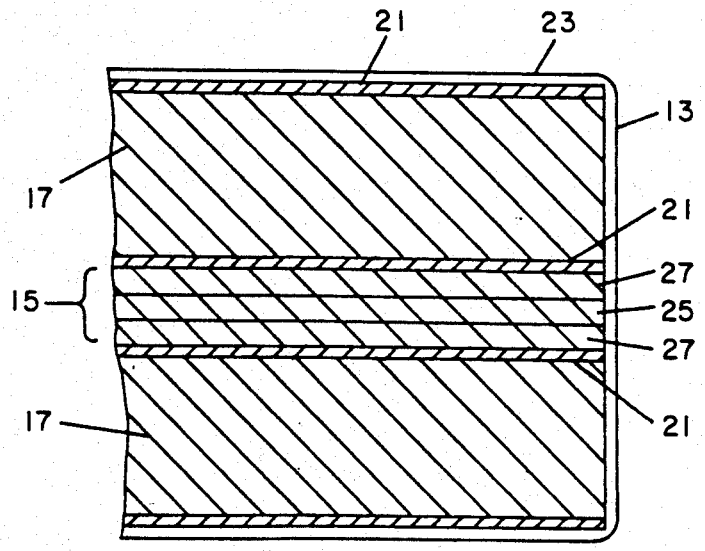
FIG. 3 is an enlarged cross sectional view of a portion of one of the conductors shown in FIG. 2.

Referring now to the drawing and particularly FIGS. 1 and 2, thereof, a cross section of a coil 11 fabricated in accordance with the present invention is shown. A tape conductor 13 used to wind the coil 11 is shown in cross section in FIG. 3. The tape conductor comprises a superconductive foil 15 soldered between two foils 17 of electrically conductive material such as copper. The outside of the layers of foil is enclosed by lead tin solder 21 which is also shown between the foils. The tape can be insulated by a film insulation or a spiral wrap 23 of filamentary insulation such as polyester synthetic fiber, nylon, glass or quartz. The superconductor foil shown is niobium tin which has been partially reacted, with the central portion of the foil 25 unreacted Niobium, to permit handling without breakage. The regions around the central portion are Niobium Tin. Any superconductive foil is suitable. The foil used in the present invention is nonfilamentary. The foil is long, wide and thin without subdivisions. The superconductive properties of the foil are exhibited along its length and width.

To fabricate a self supported rigid winding, composite structure a demountable coil form, such as the one shown in copending application Ser. No. 395,634 herein incorporated by reference, can be used. The tape is wound in a helical fashion with each subsequent layer proceeding helically in an opposite direction from the previous layer, so that the windings are not all aligned as occur in pancake windings. Layer to layer glass cloth is applied as interlayer insulation if the tape is film insulated, but is not required if the tape has a filament wrap. The glass cloth or filament winding helps wick the epoxy resin between the coil layers. To provide protection to the tape during a quench, perforated copper foil loops 31 are embedded in the winding, for example, in every sixth layer. The loops can be 10 mils, thick, for example, with 20 mil holes and 20 mil spacing between holes. The ends of each loop are overlapped and soldered creating a shorted turn. The copper foil loop forms an electrically shorted turn which surrounds the coil. A small section at the edge of the loop is removed to allow the tape to pass through the loop and be wound to form additional layers. The perforations in the copper allow the epoxy to penetrate the foil and assure good bond between layers. The use of shorted loops is shown and claimed in copending application Ser. No. 412, 254 which is a continuation of Ser. No. 215, 479, now abandoned, filed July 5, 1988, entitled "Superconductive Quench Protected Magnet Coil" and is hereby incorporated by reference.

After the winding has been completed with the shorted copper loops 31 embedded in the coil, additional layers of shorted copper loops 31 and glass cloth can be added to the outer diameter. Layers of glass cloth are added to permit machining of the outer diameter, if necessary, without disturbing the copper loops. The copper loops can be fabricated from hardened copper to provide additional strength. The coil form is placed in a pan and vacuum epoxy impregnation.

The shorted copper loops propagate a quench quickly throughout the coil and to other coils having shorted copper loops by the heat generated by the induced currents in the shorted loops caused by the magnetic field created by the reduced current flowing in the quenched portion of the coil. The superconductive turns adjacent the shorted copper loops heat up and quench dissipating the stored energy throughout the coils. The shorted copper loops also add strength to the coil which is subjected to forces attempting to expand the coil radially outwardly when the coil is energized in a magnetic field. The copper foils carry heat axially from the interior of the coil to the coil exterior where heat can be removed by conduction to a cryocooler (not shown).

To assure a good penetration of the voids in the winding and the glass fabric, a low viscosity resin is preferred which will remain fluid for long periods of time to allow the resin to infiltrate the coil structure. A resin which can then be cured in a reasonable period of time, 12 to 20 hours, is also desired.

A preferred composition which gives the best balance of low viscosity, long processing time, and good cure reactivity is the following:

100 parts epoxy resin
100 parts hardener
18.5 parts reactive diluent
0.4% accelerator (based on the total weight of the formulation)

The epoxy resin is a diglycidyl ether of Bisphenol A, available, for example, from Ciba-Geigy as GY6005, the hardener is nadic methyl anhydride, the reactive diluent is 1,4 butanediol diglycidyl ether, a diepoxide, and the accelerator is octyldimethylaminoboron trichloride.

Vacuum pressure cycles are applied with the coil covered with liquid resin to insure full penetration into the coil without voids. The resin is maintained at 80° C. and has a viscosity of less than 50 centipoise. Following curing which typically takes place at an elevated temperature of 100° C. for 12 to 20 hours, the coil is removed from the coil form and can be assembled into a magnet cartridge of the type shown in copending application Ser. No. 395,636 and herein incorporated by reference.

Figure 4:
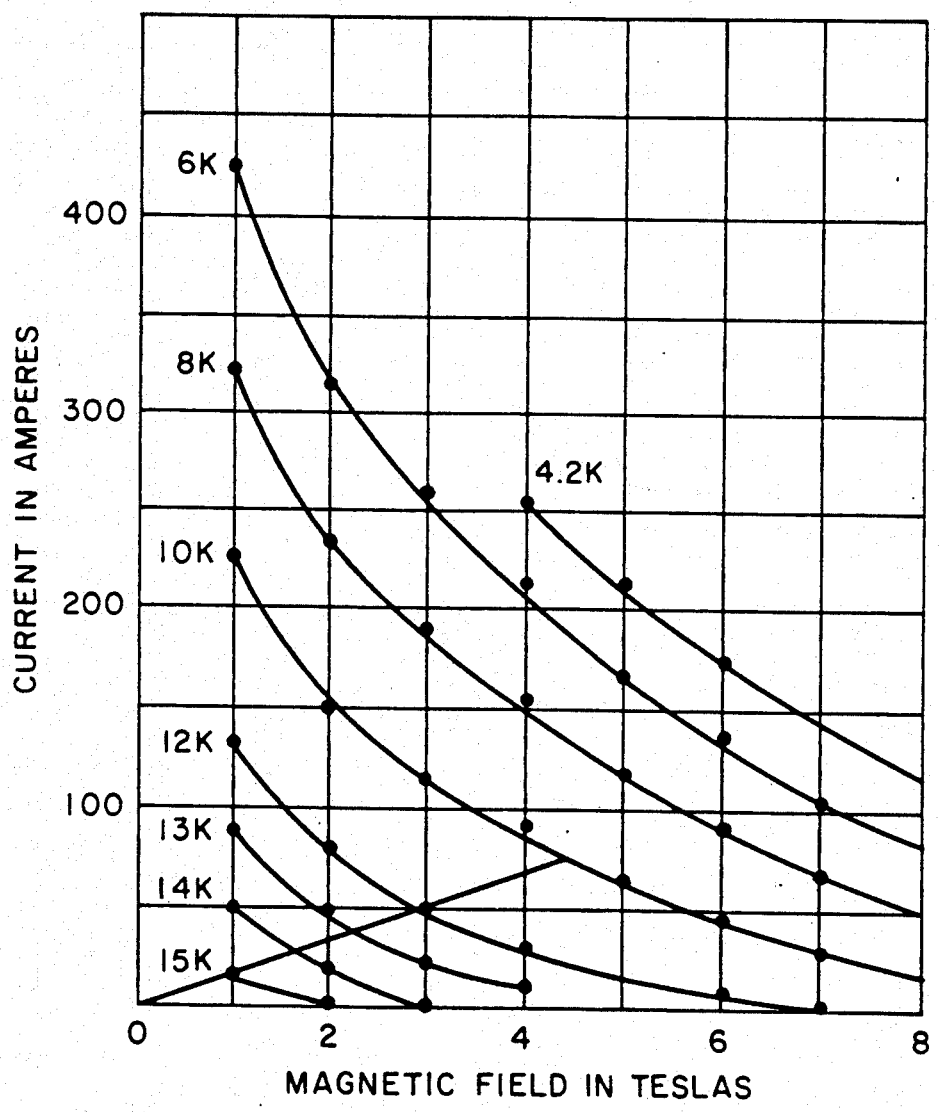
FIG. 4 is a graph showing the characteristics of short samples of a 2.5 mm Niobium tin tape.

The tape width and thickness of copper and insulation are important parameters that affect the stability of a coil fabricated from superconductive foil. Stability of epoxy impregnated tape coils without helium cooling is governed by the following equation:

$$b_s = \frac{U_o y^2 J_c^2 a^2}{C_p(T_c - T_o)} < b_c = \frac{3}{1 + 3i^2}$$

where $b_s$=stability parameter
$b_c$=critical value
$U_o = 4\pi \times 10^{-7}$ Volt Seconds/Ampere meter
y=operating current/critical current
a=half width of tape
$C_p$=volumetric specific heat of composite
$T_c$=critical temperature at local field
$T_o$=local temperature
$J_c$=critical current at local field and temperature As an example, consider a magnet which is to operate at 10° K with a peak radial field of 3 T. The short sample characteristic curves of a 2.5 mm niobium-tin tape are shown in FIG. 4. The superconductor current I is 50 A, and the critical current $I_c$ is 120 A. The tape configuration for an epoxy impregnated coil of the type shown in FIG. 1 having a tape of 0.001" thick niobium tin foil, soldered between copper foils results in the following parameters:

$$y = \frac{0.001}{0.012} = 0.083, i = \frac{50}{120} = 0.42, a = 1.25 \text{ mm},$$

$C_p = 1.75\ 10^4\ J/m^3K$, $T_c - T_o = 14 - 10 = 4K$
$J_c = 1890\ A/mm^2$ at 3 T, 10K

The dynamic stability of the tape in the field range of 1-3 T is presented in Table 1.

TABLE I

Tape Coil Stability

| Field in Tesla | $I_c$ in Amps | $T_c$ in Degree K | $I/I_c$ | $yJ_c$ in units of $10^8$ A/m$^2$ | $b_s$ | $b_c$ |
|---|---|---|---|---|---|---|
| 1 | 230 | 15.5 | 0.217 | 3.02 | 1.86 | 2.63 |
| 2 | 155 | 15 | 0.323 | 2.03 | 0.92 | 2.28 |
| 3 | 120 | 14 | 0.417 | 1.57 | 0.69 | 1.97 |

It is clear that $b_s < b_c$, therefore the tape is expected to be stable.

The increase flux jump stability of the coils of the present invention which permits their operation with conduction cooling without the use of consumable cryogens is throught to be due to the increased heat capacity of the materials used when operating above liquid helium temperatures and also due to the improved mechanical stability of coils fabricated in accordance with the present invention. The helical winding rather than pancake windings as well as the shorted loops of conductive metal also are thought to contribute to the coil's stability.

While epoxy impregnated tape coils find application in MR magnets, epoxy impregnated coils, not limited to circular configuratons, can be fabricated and used wherever a superconductive coil is needed which does not require cryogen cooling.

While the invention has been particularly shown and described with reference to an embodiment thereof, it will be understood by those skilled in the art that various changes in form and detail may be made without departing from the spirit and scope of the invention.

What is claimed is:

1. A superconductive tape coil comprising:

a superconductive foil;

a first and second foil of current conducting material soldered symmetrically about said superconductive foil forming a superconductive tape, said tape wound in helical layers forming a coil; adjacent turns of tape electrically insulated from one another;

a strip of electrically conductive foil situated between layers of tape and electrically insulated therefrom, said strip of conductive foil enclosing the inner layers of tape, the ends of said strip joined together to form an electrically conductive loop; and epoxy resin impregnating said coil.

2. The superconductive tape coil of claim 1 further comprising a plurality of layers of conductive foil loops surrounding said helically wound layers of tape, said plurality of layers of loops epoxy resin impregnated.

3. The superconductive coil of claim 2 wherein said electrically conductive foil in said loops comprises hardened copper.

4. The superconductive coil of claim 3 further comprises a plurality of layers of glass cloth with a layer of glass cloth between each of said plurality of layers of electrically conductive loops surrounding said helically wound tape.

5. The superconductive tape coil of claim 4 wherein said hardened copper foils are perforated.

6. The superconductive tape coil of claim 1 wherein said tape is covered with a spiral wrap of filamentary insulation.

7. A superconductive tape coil for use with refrigeration cooling comprising:

a superconductive foil having a width greater than its thickness and the same superconductive properties along its length as across its width;

a first and second foil of current conducting material soldered symmetrically about said superconductive foil forming a superconductive tape, said tape wound in helical layers forming a coil, adjacent turns of tape electrically insulated from one another;

a strip of electrically conductive foil situated between layers of tape and electrically insulated therefrom, said strip of conductive foil enclosing the inner layers of tape, the ends of said strip joined together to form an electrically conductive loop; and epoxy resin impregnating said coil.

8. The superconductive tape coil of claim 7 further comprising a plurality of layers of conductive foil loops surrounding said helically wound layers of tape, said plurality of layers of loops epoxy resin impregnated.

9. The superconductive coil of claim 8 wherein said electrically conductive foil in said loops comprises hardened cooper.

10. The superconductive coil of claim 9 further comprises a plurality of layers of glass cloth with a layer of glass cloth between each of said plurality of layers of electrically conductive loops surrounding said helically wound tape.

11. The superconductive tape coil of claim 10 wherein said hardened copper foils are perforated.

12. The superconductive tape coil of claim 7 wherein said tape is covered with a spiral wrap of filamentary insulation.

* * * * *